US011776478B2

(12) United States Patent
Chung et al.

(10) Patent No.: US 11,776,478 B2
(45) Date of Patent: Oct. 3, 2023

(54) ELECTROLUMINESCENT DISPLAY DEVICE

(71) Applicant: LG Display Co., Ltd., Seoul (KR)

(72) Inventors: Eui-Hyun Chung, Paju-si (KR); Sung-Hun Kim, Paju-si (KR); Da-Hye Shim, Paju-si (KR); Soon-Hwan Hong, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/506,563

(22) Filed: Oct. 20, 2021

(65) Prior Publication Data

US 2022/0122541 A1 Apr. 21, 2022

(30) Foreign Application Priority Data

Oct. 21, 2020 (KR) ..... 10-2020-0136733

(51) Int. Cl.
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2310/08* (2013.01); *G09G 2330/028* (2013.01)

(58) Field of Classification Search
CPC ..... G09G 2300/0819; G09G 2300/0852
See application file for complete search history.

(56) References Cited

U.S. PATENT DOCUMENTS 8,368,618 B2 2/2013 Choi
2004/0178982 A1* 9/2004 Chen ..... G09G 3/3648 345/100
2006/0077333 A1* 4/2006 Imajo ..... G02F 1/13306 349/149
2009/0051674 A1* 2/2009 Kimura ..... G09G 3/3291 345/204

(Continued)

FOREIGN PATENT DOCUMENTS

KR 10-1056241 B1 8/2011
KR 10-1878189 B1 7/2018

(Continued)

OTHER PUBLICATIONS

Organic Light Emitting Diode Display Device KR 20210132778 (Year: 2021).*

(Continued)

*Primary Examiner* — Van N Chow
(74) *Attorney, Agent, or Firm* — Fenwick & West LLP

(57) ABSTRACT

An electroluminescent display device includes a display panel including a display region, which includes a plurality of pixel arrangement regions and a plurality of scan circuit regions between the plurality of pixel arrangement regions, and a non-display region around the display region; a scan driving circuit formed in the plurality of scan circuit regions, and a clock signal line transferring a clock signal, and a first voltage line and a second voltage line located at both sides of the clock signal line, the clock signal line and the first and second voltage lines being located in the scan circuit region, (Continued)

wherein the first voltage line transfers a low potential driving voltage which is supplied to a cathode corresponding to the display region.

22 Claims, 11 Drawing Sheets

(56) References Cited

U.S. PATENT DOCUMENTS

2009/0189835 A1* 7/2009 Kim ..... G09G 3/3677 345/80
2010/0156762 A1 6/2010 Choi
2011/0084960 A1* 4/2011 Miyake ..... G09G 3/3266 377/64
2014/0354523 A1* 12/2014 So ..... G09G 3/3677 345/100
2016/0005372 A1* 1/2016 Yu ..... G09G 3/20 345/94
2017/0018220 A1* 1/2017 Takahara ..... G09G 3/3266
2017/0192584 A1* 7/2017 Wang ..... G06F 3/0412
2018/0330668 A1* 11/2018 Luo ..... H01L 29/78648
2022/0190097 A1* 6/2022 Sakai ..... H01L 27/3276

FOREIGN PATENT DOCUMENTS

KR 10-2020-0066844 A 6/2020
KR 20210132778 A * 10/2021

OTHER PUBLICATIONS

Werner, K. "Display Materials and Processes," Sep. 2015, eight pages, [Online] [Retrieved on Sep. 28, 2021] Retrieved from the Internet <URL: http://archive.informationdisplay.org/id-archive/2015/septemberoctober/reviewmaterialsprocesses>.

* cited by examiner

ELECTROLUMINESCENT DISPLAY DEVICE

CROSS REFERENCE TO RELATED APPLICATIONS

The present application claims the priority benefit of Republic of Korea Patent Application No. 10-2020-0136733 filed in Republic of Korea on Oct. 21, 2020, which is hereby incorporated by reference in its entirety for all purposes as if fully set forth herein.

BACKGROUND

Field

The present disclosure relates to an electroluminescent display device.

Discussion of the Related Art

With the advent of an information-oriented society, needs for display devices have increased in various types. Recently, various flat display devices, such as electroluminescent display devices including organic light emitting diode (OLED) display devices, quantum dot light emitting diode (QLED) display devices and micro-light emitting diode (micro LED) display devices, have been used.

Because, the electroluminescent display device has advantages of small size, light weight, thin profile and low power driving, it is widely used.

Recently, the electroluminescent display device uses a gate in panel (GIP) type, and a gate driving circuit is formed at both sides of a display region.

In this case, a width of a bezel of a display device increases.

SUMMARY

Accordingly, the present disclosure is directed to an electroluminescent display device that substantially obviates one or more of the problems due to limitations and disadvantages of the related art.

An advantage of the present disclosure is to provide an electroluminescent display device which can reduce a width of a bezel and realize a narrow bezel.

Additional features and advantages of the disclosure will be set forth in the description which follows, and in part will be apparent from the description, or may be learned by practice of the invention. These and other advantages of the invention will be realized and attained by the structure particularly pointed out in the disclosure.

To achieve these and other advantages and in accordance with the purpose of the present disclosure, as embodied and broadly described herein, an electroluminescent display device includes a display panel including a display region, which includes a plurality of pixel arrangement regions and a plurality of scan circuit regions between the plurality of pixel arrangement regions, and a non-display region around the display region; a scan driving circuit formed in the plurality of scan circuit regions, and a clock signal line transferring a clock signal, and a first voltage line and a second voltage line located at both sides of the clock signal line, the clock signal line and the first and second voltage lines being located in the scan circuit region, wherein the first voltage line transfers a low potential driving voltage which is supplied to a cathode corresponding to the display region.

In another aspect, an electroluminescent display device includes a display panel including a display region, which includes a plurality of pixel arrangement regions and a plurality of scan circuit regions between the plurality of pixel arrangement regions, and a non-display region around the display region, a scan driving circuit formed in the plurality of scan circuit regions, and a clock signal line transferring a clock signal, and a first voltage line and a second voltage line located at both sides of the clock signal line, the clock signal line and the first and second voltage lines being located in the scan circuit region, wherein the first and second voltage lines transfer voltages of different direct current (DC) waveforms.

It is to be understood that both the foregoing general description and the following detailed description are exemplary and explanatory and are intended to provide further explanation of the disclosure as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the disclosure.

DETAILED DESCRIPTION

Reference will now be made in detail to exemplary embodiments, examples of which are illustrated in the accompanying drawings. The same reference numbers may be used throughout the drawings to refer to the same or like parts.

Figure 1:
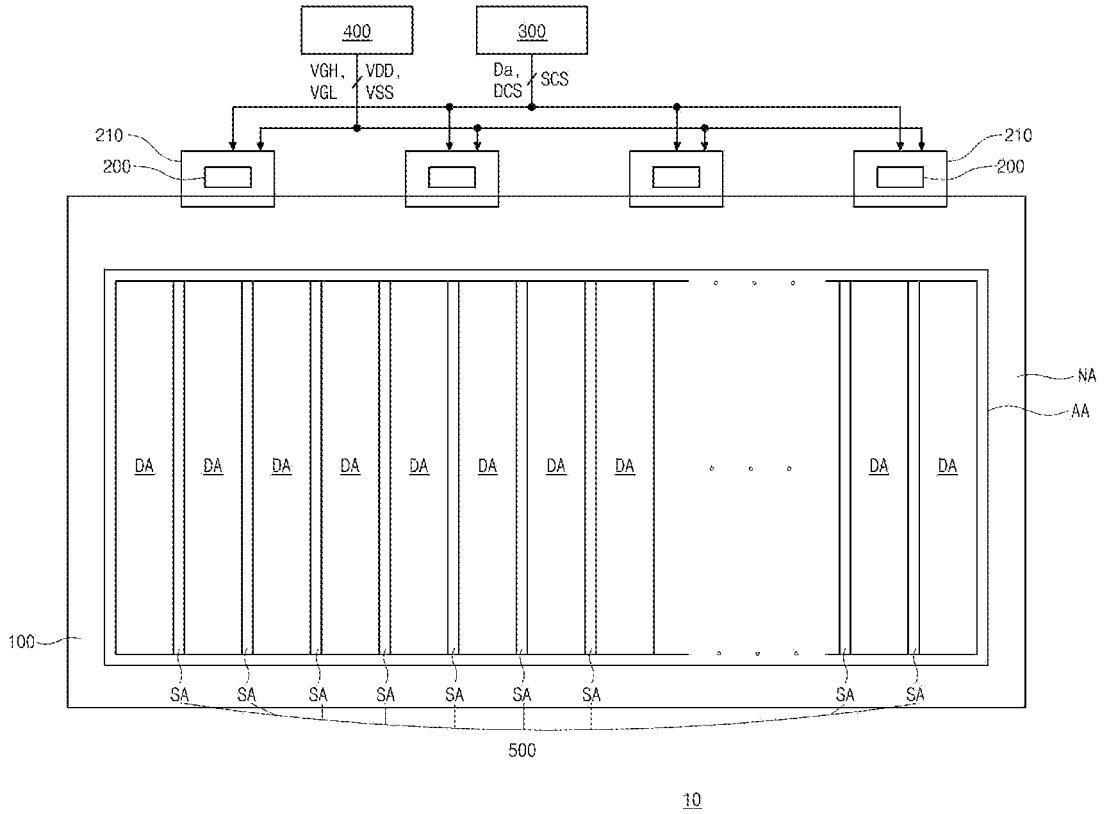
FIG. 1 is a view illustrating an electroluminescent display device according to an embodiment of the present disclosure.

FIG. 1 is a view illustrating an electroluminescent display device according to an embodiment of the present disclosure.

Referring to FIG. 1, the electroluminescent display device 10 may include a display panel 100 in which a plurality of pixels are arranged in a matrix form, and a panel driving circuit driving the display panel 100.

The panel driving circuit driving the display panel 100 may include a data driving circuit 200, a scan driving circuit 500, a timing control circuit 300 and a power supply circuit 400.

Regarding the display panel 100, the display panel 100 may include a display region (or active region) AA having the pixel regions arranged therein and displaying an image, and a non-display region (or non-active region) NA located outside and surrounding the display region AA.

Each pixel in the display region AA may include a plurality of sub-pixels emitting different colors. For example, each pixel may include a red (R) sub-pixel, a green (G) sub-pixel and a blue (B) sub-pixel are arranged adjacently along each row line direction. The pixel and the sub-pixel are explained in detail below.

Various signal lines transferring driving signals to drive the pixels (or the sub-pixels) may be formed on a substrate in the display panel 100. In this regard, for example, each of a plurality of data lines transferring data signals (or data voltages) as image signals may extend along a column line direction (or vertical direction or first direction) and be connected to a sub-pixel on a corresponding column line. Further, each of a plurality of gate lines transferring gate signals may extend along a row line direction (or horizontal direction or second direction) and be connected to a sub-pixel on a corresponding row line. Further, each of a plurality of emission lines being in parallel with the gate line and extending along a row direction may be connected to a sub-pixel on a corresponding column line. Such the signal lines of the display panel 100 are explained in detail below.

The timing control circuit 300 may control driving timings of the data driving circuit 200 and the scan driving circuit 500.

In this regard, the timing control circuit 300 may process digital data signals Da input from an external system in accordance with an optical property of the display panel 100 and supply the processed data signals.

The timing control circuit 300 may generate a data control signal (DCS) to control a driving timing of the data driving circuit 200 and a scan control signal (SCS) to control a driving timing of the scan driving circuit 500 based on timing signals, such as a vertical synchronization signal, a horizontal synchronization signal, a clock signal and a data enable signal, input from the external system.

The power supply circuit 400 may supply various voltages to drive components of the electroluminescent display device 10. For example, the power supply circuit 400 may output a first logic voltage (or low logic voltage) VGL and a second logic voltage (or high logic voltage) VGH to drive the scan driving circuit 500, and a first power voltage (or low potential driving voltage) VSS and a second power voltage (or high potential driving voltage) VDD to drive the display panel 100.

The data driving circuit 200 may drive the data lines. In this regard, the data driving circuit 200 may convert the digital data signal Da into an analog data signal (i.e., data voltage) based on the data control signal DCS and supply the analog data signal to the corresponding data line.

The data driving circuit 200 may be configured in an IC type. In this regard, the data driving circuit 200 may include at least one driving IC. In this embodiment, the data driving circuit 200 may be configured with a plurality of driving ICs. Each driving IC may be mounted on a flexible circuit film 210 and be connected to the display panel 100. Alternatively, the driving IC may be mounted directly on a substrate of the display panel 100 as configured in a COG type IC.

In the flexible circuit film 210, lines, which serve to transfer the control signal SCS and the voltages VGL and VGH driving the scan driving circuit 500 and the voltages VSS and VDD driving the display panel 100 to the display panel 100, may be formed at portions outside the driving IC.

The scan driving circuit 500 may output respective scan signals to the gate line and the emission line connected thereto and drive the gate line and the emission line. In this regard, the scan driving circuit 500 may generate the scan signals, for example, a gate signal and an emission signal based on the scan control signal SCS and supply these signals to the corresponding signal lines. In this regard, the scan driving circuit 500 may output the gate signals to the gate lines in a sequential line-scanning manner, and output the emission signals to the emission lines in a sequential line-scanning manner.

The scan driving circuit 500 may be formed in a GIP type directly at an array substrate of the display panel 100.

In this embodiment, the scan driving circuit 500 may not be formed in the non-display region NA but may be formed to disperse in the display region AA.

In this regard, the display region AA may include a plurality of pixel arrangement regions DA in which the pixels are arranged, and a plurality of scan circuit regions SA which are located between the plurality of pixel arrangement regions DA and form the scan driving circuit 500.

A plurality of pixels arranged in a matrix form may be located in each pixel arrangement region DA, and the pixel arrangement region DA may substantially produce an image. The pixel arrangement regions DA may extend in parallel with each other along the column line direction, and may be separated from each other with the scan circuit regions SA therebetween along the row line direction.

Each scan circuit region SA may be located between the neighboring pixel arrangement regions DA, and a partial circuit constituting the scan driving circuit 500 may be formed at each scan circuit region SA. The scan circuit regions SA may extend in parallel with each other along the column line direction, and may be separated from each other with the pixel arrangement regions DA therebetween along the row line direction.

As described above, the display region AA may be configured such that the scan circuit regions SA are dispersed inside the display region AA and the pixel arrangement regions DA as actual image display regions are divided.

The plurality of pixel arrangement regions DA arranged in the display region AA may be formed to have substantially the same width of a row line direction. In this regard, the plurality of pixel arrangement regions DA may have the same number of pixels arranged along a row line direction.

The plurality of scan circuit regions SA arranged in the display region AA may be formed to have substantially the same width of a row line direction. Further, the scan circuit regions SA may have the same interval (or pitch), and in this case, the plurality of pixel arrangement regions DA have substantially the same width.

As described above, in this embodiment, the scan driving circuit 500 generating the scan signals may be formed in the display region AA. Accordingly, because the scan driving circuit 500 does not need to be formed in the non-display region NA, a width of the non-display region NA can be reduced and a narrow bezel can be realized effectively.

Further, the scan driving circuit 500 may be configured such that a plurality of scan signal generating circuits which each are a unit circuit generating scan signals may be formed over the plurality of scan circuit regions SA. For example, for m scan circuit regions SA defined in the display region AA, k scan signal generating circuits may be formed (where k is a natural number which is over 1, and is m or less). The plurality of scan signal generating circuits may be spaced apart from each other all over the display region AA. Accordingly, a deviation of scan signal by position on the row line direction of the display region AA can be substantially reduced, and thus a uniformity of driving property all over the display region AA can be improved and a display quality can be improved.

A configuration of the scan driving circuit 500 is explained in detail.

Figure 2:
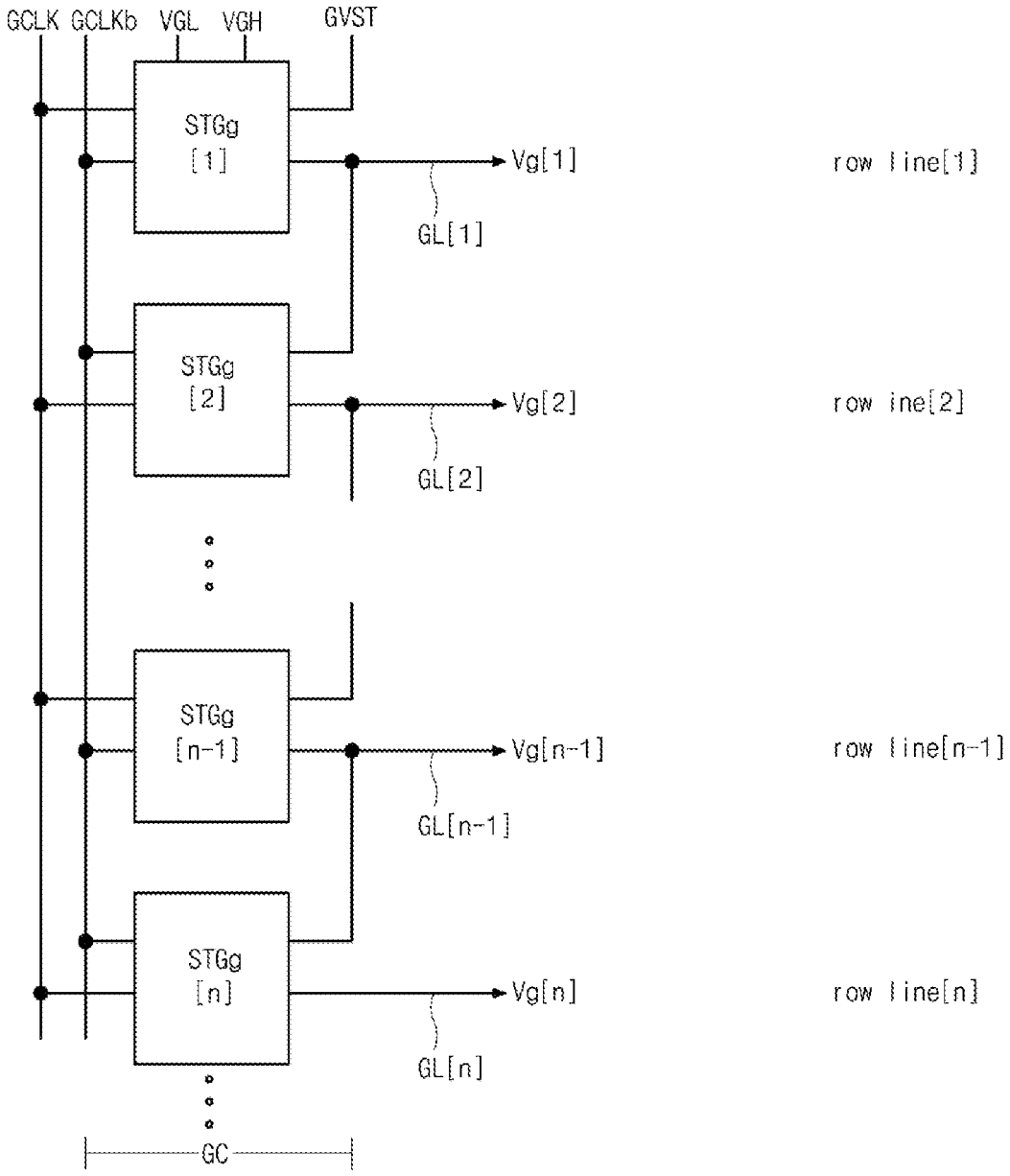
FIG. 2 is a view illustrating a conceptual configuration of a gate signal generating circuit of a scan driving circuit according to an embodiment of the present disclosure.
Figure 3:
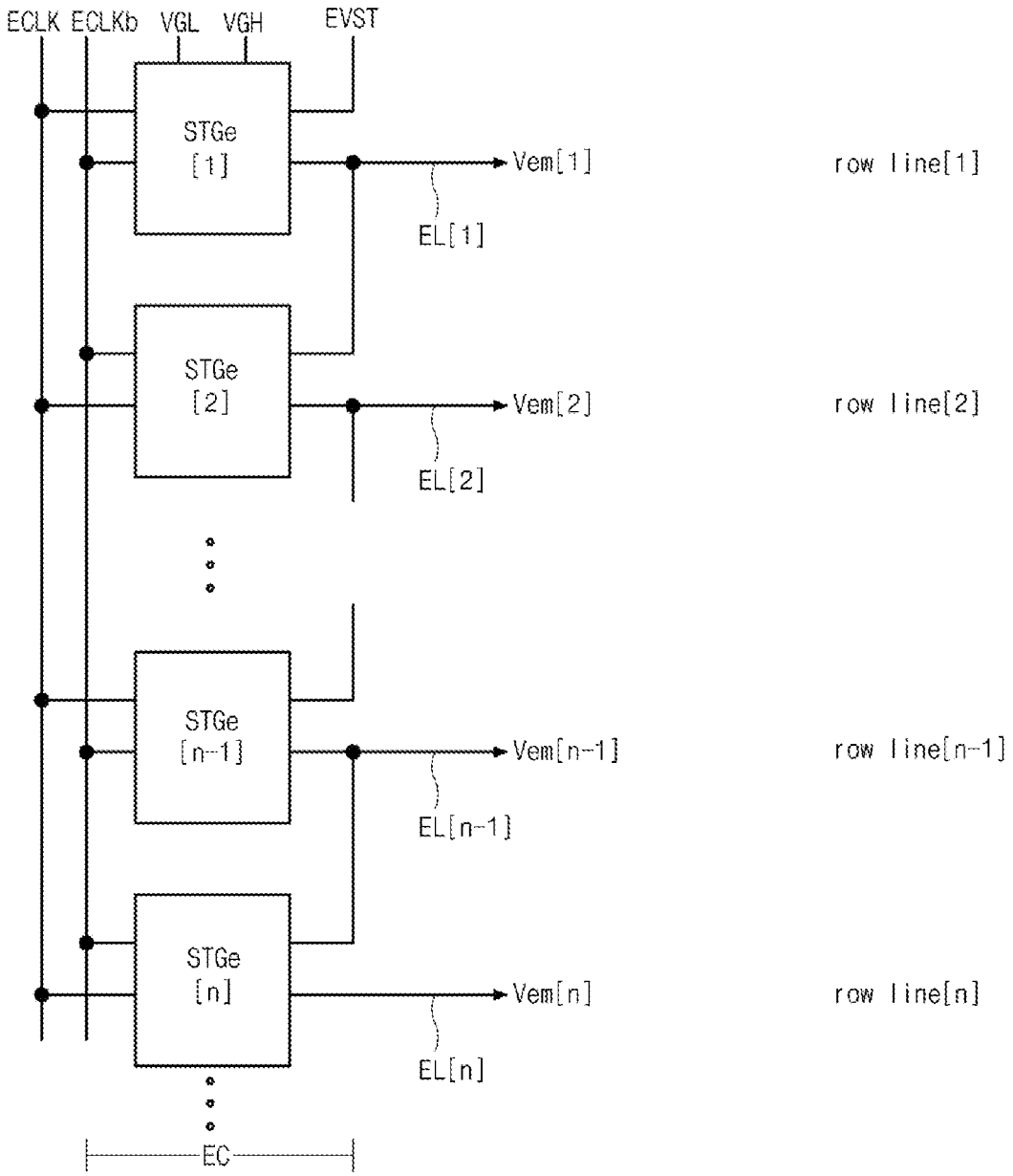
FIG. 3 is a view illustrating a conceptual configuration of an emission signal generating circuit of a scan driving circuit according to an embodiment of the present disclosure.

FIG. 2 is a view illustrating a conceptual configuration of a gate signal generating circuit of a scan driving circuit according to an embodiment of the present disclosure, and FIG. 3 is a view illustrating a conceptual configuration of an emission signal generating circuit of a scan driving circuit according to an embodiment of the present disclosure.

Referring to FIGS. 1 to 3, the scan driving circuit 500 may include a gate signal generating circuit GC as a scan signal generating circuit which generates gate signals Vg, and an emission signal generating circuit EC as a scan signal generating circuit which generates emission signals Vem.

Referring to FIG. 2, the gate signal generating circuit GC may include a plurality of stages STGg which are connected in cascade to each other and sequentially generate the gate signals Vg to the corresponding row lines. For the purpose of explanations, the stages (STGg[1], STGg[2], STGg[n−1] and STGg[n]) corresponding to some row lines ($1^{st}$, $2^{nd}$ $(n-1)^{th}$ and $n^{th}$ lines) are shown.

Even though not shown in the drawings, each stage STGg may include a plurality of transistors and at least one capacitor to output the gate signal Vg as a scan signal. For example, each stage STGg may include a Q transistor and a Qb transistor connected in series to each other with an output node (or output terminal) which is connected to the corresponding gate line GL and is located between the Q transistor and the Qb transistor, and a control circuit controlling switching operations of the Q transistor and the Qb transistor. The Q transistor may output the gate signal Vg of a turn-on level to the gate line GL, and the Qb transistor may output the gate signal Vg of a turn-off level to the gate line GL. For example, in case that a switching transistor of the sub-pixel connected to the gate line GL is a P type transistor, the Q transistor may output the gate signal Vg of a low level and the Qb transistor may output the gate signal Vg of a high level.

Each stage STGg may receive, for example, a gate signal Vg output from a previous stage and use it as a start signal. For example, the stage STGg[2] may receive a gate signal Vg[1] output from a previous stage STGg[1] and use it as a start signal, the stage STGg[n] may receive a gate signal Vg[n−1] output from a previous stage STGg[n−1] and use it as a start signal, and so on. The stage STGg[1] of the first row line may receive an extra start signal GVST.

The stage STGg may receive clock signals, for example, a first gate clock signal GCLK and a second gate clock signal GCLKb which have different phases from each other, and a first logic voltage VGL and a second logic voltage VGH which are opposite phases from each other.

The stage STGg may output the corresponding gate clock signal as the gate signal Vg through the Q transistor for a horizontal period of the corresponding row line. For example, the first stage STGg[1] may output the first gate clock signal GCLK as the gate signal Vg[1] through its Q transistor, and the second stage STGg[2] may output the second gate clock signal GCLKb as the gate signal Vg[2] through its Q transistor.

The stage STGg may output the first or second logic voltage VGL or VGH of a turn-off level voltage as the gate signal Vg through the Qb transistor after the horizontal period. For example, in case that a switching transistor of the sub-pixel connected to the gate line GL is a P type transistor, the second logic voltage VGH as a high logic voltage may be output as the gate signal Vg.

As described above, regarding the gate signal generating circuit GC generating the gate signal Vg on each row line, a plurality of gate signal generating circuits GC may be arranged inside the display region AA. In other words, the plurality of gate signal generating circuits GC may be arranged in the display region AA, and to do this, the scan circuit regions SA where the plurality of gate signal generating circuits GC are formed may be located in the display region AA.

Referring to FIG. 3, the emission signal generating circuit EC may be configured similar to the gate signal generating circuit GC. The emission signal generating circuit EC may include a plurality of stages STGe which are connected in cascade to each other and sequentially generate the emission signals Vem to the corresponding row lines. For the purpose of explanations, the stages (STGe[1], STGe[2], STGe[n−1] and STGe[n]) corresponding to some row lines ($1^{st}$, $2^{nd}$, $(n-1)^{th}$ and $n^{th}$ lines) are shown.

Even though not shown in the drawings, each stage STGe may include a plurality of transistors and at least one capacitor to output the gate signal Vem as a scan signal. For example, each stage STGe may include a Q transistor and a Qb transistor connected in series to each other with an output node (or output terminal) which is connected to the corresponding emission line EL and is located between the Q transistor and the Qb transistor, and a control circuit controlling switching operations of the Q transistor and the Qb transistor. The Q transistor may output the emission signal Vem of a turn-on level to the emission line EL, and the Qb transistor may output the emission signal Vem of a turn-off level to the emission line EL. For example, in case that a switching transistor of the sub-pixel connected to the emission line EL is a P type transistor, the Q transistor may output the emission signal Vem of a low level and the Qb transistor may output the emission signal Vem of a high level.

Each stage STGe may receive, for example, an emission signal Vem output from a previous stage and use it as a start signal. For example, the stage STGe[2] may receive an emission signal Vem[1] output from a previous stage STGe [1] and use it as a start signal, the stage STGe[n] may receive an emission signal Vem[n−1] output from a previous stage STGe[n−1] and use it as a start signal, and so on. The stage STGe[ 1] of the first row line may receive an extra start signal EVST.

The stage STGe may receive clock signals, for example, a first emission clock signal ECLK and a second emission clock signal ECLKb which have different phases from each other, and a first logic voltage VGL and a second logic voltage VGH which are opposite phases from each other.

The stage STGe may output one of the first and second logic voltages VGL and VGH of a turn-on level voltage as the emission signal Vem through the Q transistor for an emission period of the corresponding row line, and the stage STGe may output the other of the first and second logic voltages VGL and VGH of a turn-off level voltage as the emission signal Vem through the Qb transistor after the emission period (i.e., for a non-emission period). For example, in case that the switching transistor of the sub-pixel connected to the emission line EL is a P type transistor, the first logic voltage VGL of a low logic voltage may be output through the Q transistor for the emission period, and the second logic voltage VGH of a high logic voltage may be output through the Qb transistor for the non-emission period.

As described above, regarding the emission signal generating circuit EC generating the emission signal Vem on each row line, a plurality of emission signal generating circuits EC may be arranged inside the display region AA. In other words, the plurality of emission signal generating circuits EC may be arranged in the display region AA, and to do this, the scan circuit regions SA where the plurality of emission signal generating circuits EC are formed may be located in the display region AA.

An arrangement of the gate signal generating circuit GC and the emission signal generating circuit EC in the display region AA is described below.

Figure 4:
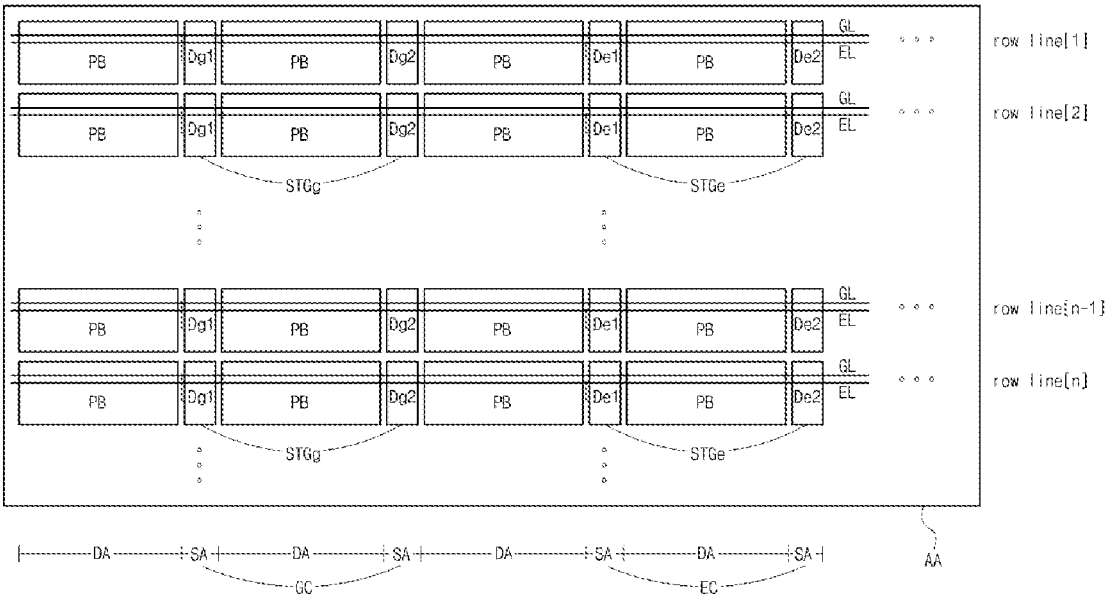
FIG. 4 is a view schematically illustrating an example of an arrangement of a gate signal generating circuit and an emission signal generating circuit of a scan driving circuit according to an embodiment of the present disclosure.
Figure 5:
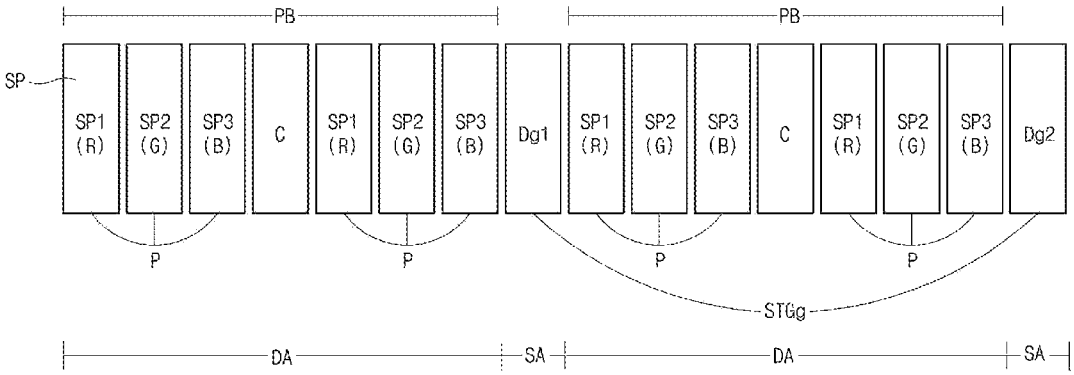
FIG. 5 is a view schematically illustrating a configuration of a pixel block according to an embodiment of the present disclosure.

FIG. 4 is a view schematically illustrating an example of an arrangement of a gate signal generating circuit and an emission signal generating circuit of a scan driving circuit according to an embodiment of the present disclosure, and FIG. 5 is a view schematically illustrating a configuration of a pixel block according to an embodiment of the present disclosure.

In FIG. 4, for the purpose of explanations, one gate signal generating circuit GC and one emission signal generating circuit EC arranged in the display region AA are shown. The arrangement shown in FIG. 4 may be repeated along the column line direction in the display region AA, and a plurality of gate signal generating circuits GC and a plurality of emission signal generating circuits EC may be formed in the display region AA.

Referring to FIGS. 1 to 4, each gate signal generating circuit GC may be formed, for example, at neighboring scan circuit regions SA, and each emission signal generating circuit EC may be formed, for example, at neighboring scan circuit regions SA.

In this embodiment, as an example shown in FIG. 4, the gate signal generating circuit GC is formed at two neighboring scan circuit regions SA, the emission signal generating circuit EC is formed at two neighboring scan circuit regions SA, and the gate signal generating circuit GC and the emission signal generating circuit EC are formed at the different scan circuit regions SA.

The gate signal generating circuit GC may be formed in a structure that the gate signal generating circuit GC is divided in two scan circuit regions SA. For example, the stage STGg of the gate signal generating circuit GC may be configured with a first circuit portion Dg1 and a second circuit portion Dg2 which are formed separately in two scan circuit regions SA, respectively. In this embodiment, a configuration that an output terminal of the stage STGg is located at the first circuit portion Dg1 and the first circuit portion Dg1 outputs the gate signal Vg to the corresponding gate line GL is shown by way of example.

Similarly to the gate signal generating circuit GC, the emission signal generating circuit EC may be formed in a structure that the emission signal generating circuit EC is divided in two scan circuit regions SA. For example, the stage STGe of the emission signal generating circuit EC may be configured with a first circuit portion De1 and a second circuit portion De2 which are formed separately in two scan circuit regions SA, respectively. In this embodiment, a configuration that an output terminal of the stage STGe is located at the first circuit portion De1 and the first circuit portion De1 outputs the emission signal Ve to the corresponding emission line EL is shown by way of example.

In the pixel arrangement region DA, the pixel block PB may be located on each of a plurality of row lines. In other words, a plurality of pixel blocks PB may be arranged along the column line direction.

Regarding the pixel block PB, referring to FIG. 5, a plurality of pixels P arranged along the row direction may be formed in the pixel block PB of each row line. In the pixel block PB, a common control circuit block C may be located between neighboring pixels P. For example, in the pixel block PB, i pixels P may be arranged, (i−1) common control circuit block(s) C interposed between the neighboring pixels P may be arranged.

In this embodiment, for the purpose of explanations, an arrangement of two pixels P and one common control circuit block C between the two pixels P is shown by way of example.

Each pixel P may include a plurality of sub-pixels SP which neighbor each other along the row direction and have different colors. For example, the plurality of sub-pixels SP may include a first sub-pixel SP1 of a red, a second sub-pixel SP2 of a green, and a third sub-pixel SP3 of a blue.

The common control circuit block C of the pixel block PB may be connected in common to the first to third sub-pixels SP1 to SP3 of the pixel P adjacent to the common control circuit block C and may control storage capacitors of these sub-pixels SP1 to SP3 in common.

As shown in FIG. 5, in case that the two pixels P and the one common control circuit block C are located in the pixel block PB, the common control circuit block C may be connected in common to all of the two pixels P (i.e., all of the first to third sub-pixels SP1 to SP3 of the two pixels P) located at both sides of the common control circuit block C. In case that 3 or greater pixels P and common control circuit blocks C, a number of which is 1 less than a number of the pixels P, are located in the pixel block PB, one of the common control circuit blocks C may be connected to one of the pixels P and each of the other common control circuit blocks C may be connected to pixels P at both sides of each of the other common control circuit blocks C.

In the above-configured pixel block PB, the pixels P may be located at both outermost sides (i.e., left and right outermost sides) of the pixel block PB.

The scan circuit region SA may be a region in which it is possible to locate the common control circuit region C.

In this regard, regarding the arrangement on each row line, the pixel block PB and the scan circuit region SA are arranged alternately, and, in the pixel block PB, the pixel P and the common control circuit block C are arranged alternately and the pixels P are arranged at both sides of the pixel block PB. Thus, like the common control circuit block C, the scan circuit region SA is located between two neighboring pixels P.

Accordingly, the common control circuit block C may be formed to have a width substantially equal to a width of the scan circuit region SA.

As such, in this embodiment, a region which is able to be assigned as a region of the common control circuit block C may be used for the scan circuit region SA, and thus an extra region for the scan driving circuit 500 does not need to be prepared additionally in the display region AA. Further, a regularity of the pixel P and the driving circuit to drive the pixel (the common control circuit block C or scan driving circuit 500) being arranged alternately in the display region AA may be maintained substantially, and thus a display quality is not reduced but can be achieved sufficiently.

In this embodiment, a voltage line transferring the first power voltage VSS i.e., the low potential driving voltage VSS, which is a driving voltage driving a light emitting diode included in the sub-pixel SP and is applied to a cathode of the light emitting diode, may be located in the scan circuit region SA. Accordingly, a transfer line of a wide width to transfer the low potential driving voltage VSS does not need to be formed in the non-display region NA located at both sides of the display region AA, and thus a width of the non-display region NA can be reduced and a narrow bezel can be realized effectively.

Embedding the voltage line transferring the low potential driving voltage VSS in the display region AA is described.

Figure 6:
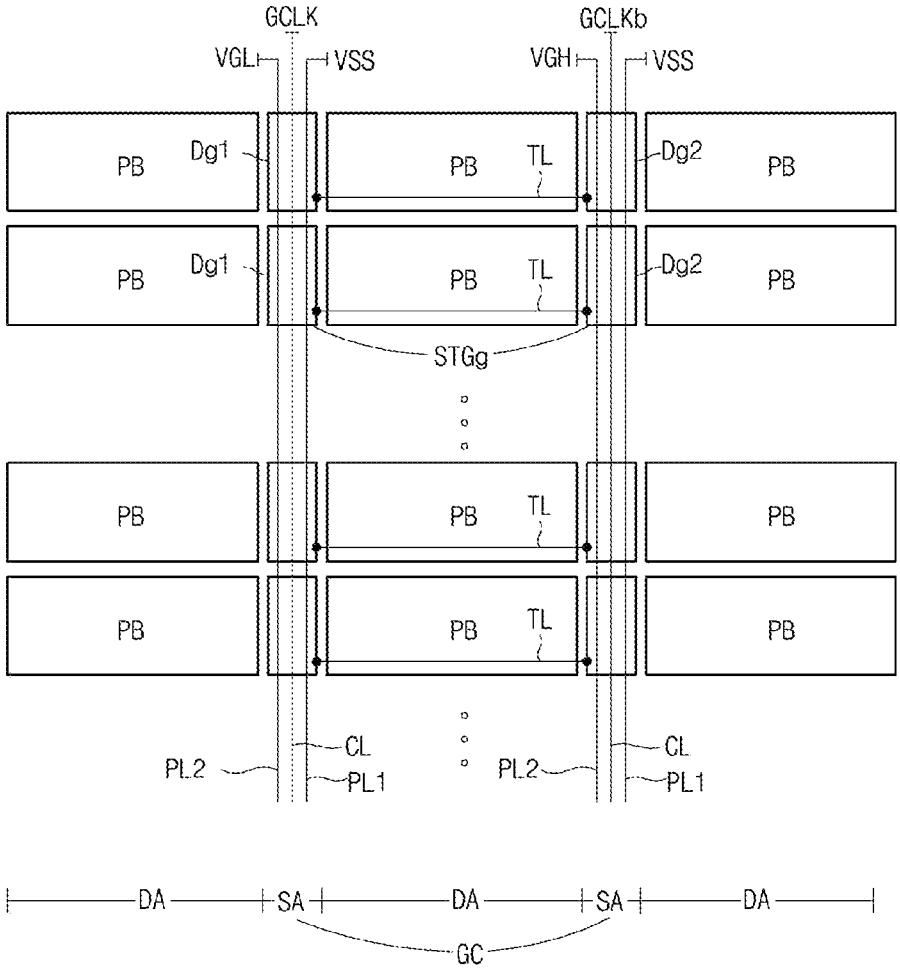
FIG. 6 is a view schematically illustrating signal lines formed along a scan circuit region where a gate signal generating circuit is located according to an embodiment of the present disclosure.
Figure 7:
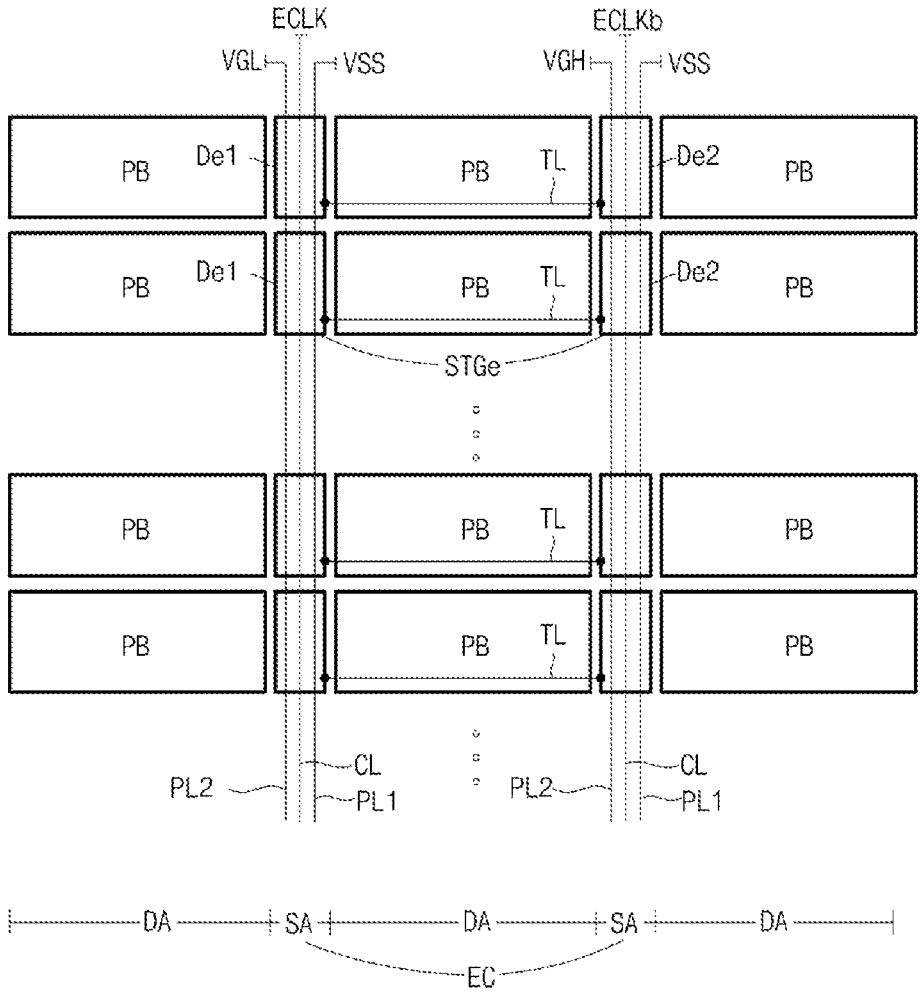
FIG. 7 is a view schematically illustrating signal lines formed along a scan circuit region where an emission signal generating circuit is located according to an embodiment of the present disclosure.

FIG. 6 is a view schematically illustrating signal lines formed along a scan circuit region where a gate signal generating circuit is located according to an embodiment of the present disclosure. FIG. 7 is a view schematically illustrating signal lines formed along a scan circuit region where an emission signal generating circuit is located according to an embodiment of the present disclosure.

Referring to FIGS. 6 and 7, in the scan circuit region SA, a plurality of transfer lines transferring signals along the column line direction, in which the scan circuit region SA extends, may extend.

In this regard, for example, as shown in FIG. 6, in each scan circuit region SA where the gate signal generating circuit GC is located, a clock signal line CL transferring the gate clock signal GCLK or GCLKb, and the first voltage line PL1 transferring the low potential driving voltage VSS, and the second voltage line PL2 transferring the logic voltage VGL or VGH may be arranged.

The clock signal lines CL respectively transferring the first and second gate clock signals GCLK or GCLKb may be located in different scan circuit regions SA. For example, the clock signal line CL transferring the first gate clock signal GCLK may be located in the scan circuit region SA where the first circuit portion Dg1 of the stage STGg may be formed, and the clock signal line CL transferring the second gate clock signal GCLKb may be located in the scan circuit region SA where the second circuit portion Dg2 of the stage STGg may be formed.

In a similar manner, the second voltage lines PL2 respectively transferring the first and second logic voltages VGL or VGH may be located in different scan circuit regions SA. For example, the second voltage line PL2 transferring the first logic voltage VGL may be located in the scan circuit region SA where the first circuit portion Dg1 of the stage STGg may be formed, and the second voltage line PL2 transferring the second logic voltage VGH may be located in the scan circuit region SA where the second circuit portion Dg2 of the stage STGg may be formed.

The first voltage line PL1 transferring the low potential driving voltage VSS may be located in the scan circuit region SA where the first circuit portion Dg1 of the stage STGg may be formed and in the scan circuit region SA where the second circuit portion Dg2 of the stage STGg may be formed.

In this embodiment, regarding the arrangement of the signal transfer lines of each scan circuit region SA, the clock signal line CL may be configured to be located between the first and second voltage lines PL1 and PL2.

In this regard, the gate clock signal GCLK or GCLKb transferred along the clock signal line CL is a signal having a pulse waveform which varies periodically in phase i.e., a signal having an Alternate Current (AC) waveform. The AC waveform signal interferes with driving of the sub-pixels SP in the pixel blocks PB adjacent to both sides of the scan circuit region SA, and thus a display quality may be reduced.

In this embodiment, at each of both sides of the clock signal line CL, the first voltage line PL1 transferring the low potential driving voltage VSS which is a voltage signal having a DC waveform, the second voltage line PL2 transferring the logic voltage VGL or VGH which is a voltage signal having a DC waveform are located. In other words, the clock signal line CL is located between the first and second voltage lines PL1 and PL2.

Accordingly, the first voltage line PL1 applied with the low potential driving voltage VSS of the DC waveform may serve to block an interference of the gate clock signal GCLK or GCLKb with the sub-pixel SP in the pixel block PB located adjacent to the first voltage line PL1. Similarly, the second voltage line PL2 applied with the logic voltage VGL or VGH of the DC waveform may serve to block an interference of the gate clock signal GCLK or GCLKb with the sub-pixel SP in the pixel block PB located adjacent to the second voltage line PL2.

Accordingly, a driving interference of the clock signals with the sub-pixels SP in the pixel blocks PB adjacent to the scan circuit region SA can be prevented, and thus a display quality can be secured.

A transmission line TL to transmit a signal between the neighboring scan circuit regions SA may be formed. In this regard, for example, as shown in FIG. 6, in case that the gate signal generating circuit GC is configured to be divided at the neighboring scan circuit regions SA, the first circuit portion Dg1 and the second circuit portion Dg2 of the stage STGg may need to be connected to each other for a signal transmission therebetween, and to do this, the transmission line TL may be formed.

Further, according to a design and the like of the scan driving circuit 500, it may be required that the first or second logic voltage VGL or VGH is supplied to a circuit portion in the other scan circuit region SA different from the scan circuit region SA where the second voltage line PL2 transferring the first or second logic voltage VGL or VGH is located, or that the first or second gate clock signal GCLK or GCLKb is supplied to a circuit portion in the other scan circuit region SA different from the scan circuit region SA where the clock signal line CL transferring the first or second gate clock signal GCLK or GCLKb is located, and to do this, the transmission line TL may be employed.

The transmission line TL may extend in parallel with the gate line GL along the row extension direction.

As shown in FIG. 7, each scan circuit region SA where the emission signal generating circuit EC is located may be configured similarly to each scan circuit region SA where the gate signal generating circuit GC is located.

In this regard, in each scan circuit region SA where the emission signal generating circuit EC is located, a clock signal line CL transferring the emission clock signal ECLK or ECLKb, and the first voltage line PL1 transferring the low potential driving voltage VSS, and the second voltage line PL2 transferring the logic voltage VGL or VGH may be arranged.

The clock signal lines CL respectively transferring the first and second emission clock signals ECLK or ECLKb may be located in different scan circuit regions SA. For example, the clock signal line CL transferring the first emission clock signal ECLK may be located in the scan circuit region SA where the first circuit portion De1 of the stage STGe may be formed, and the clock signal line CL transferring the second emission clock signal ECLKb may be located in the scan circuit region SA where the second circuit portion De2 of the stage STGe may be formed.

In a similar manner, the second voltage lines PL2 respectively transferring the first and second logic voltages VGL or VGH may be located in different scan circuit regions SA. For example, the second voltage line PL2 transferring the first logic VGL may be located in the scan circuit region SA where the first circuit portion De1 of the stage STGe may be formed, and the second voltage line PL2 transferring the second logic voltage VGH may be located in the scan circuit region SA where the second circuit portion De2 of the stage STGe may be formed.

The first voltage line PL1 transferring the low potential driving voltage VSS may be located in the scan circuit region SA where the first circuit portion De1 of the stage STGe may be formed and in the scan circuit region SA where the second circuit portion De2 of the stage STGe may be formed.

In this embodiment, regarding the arrangement of the signal transfer lines of each scan circuit region SA, the clock signal line CL may be configured to be located between the first and second voltage lines PL1 and PL2.

In this regard, the emission clock signal ECLK or ECLKb transferred along the clock signal line CL is a signal having a pulse waveform which varies periodically in phase i.e., a signal having an AC waveform. The AC waveform signal interferes with driving of the sub-pixels SP in the pixel blocks PB adjacent to both sides of the scan circuit region SA, and thus a display quality may be reduced.

In this embodiment, at each of both sides of the clock signal line CL, the first voltage line PL1 transferring the low potential driving voltage VSS which is a voltage signal having a DC waveform, the second voltage line PL2 transferring the logic voltage VGL or VGH which is a voltage signal having a DC waveform are located. In other words, the clock signal line CL is located between the first and second voltage lines PL1 and PL2.

Accordingly, the first voltage line PL1 applied with the low potential driving voltage VSS of the DC waveform may serve to block an interference of the emission clock signal ECLK or ECLKb with the sub-pixel SP in the pixel block PB located adjacent to the first voltage line PL1. Similarly, the second voltage line PL2 applied with the logic voltage VGL or VGH of the DC waveform may serve to block an interference of the emission clock signal ECLK or ECLKb with the sub-pixel SP in the pixel block PB located adjacent to the second voltage line PL2.

Accordingly, a driving interference of the clock signals with the sub-pixels SP in the pixel blocks PB adjacent to the scan circuit region SA can be prevented, and thus a display quality can be secured.

A transmission line TL to transmit a signal between the neighboring scan circuit regions SA may be formed. In this regard, for example, as shown in FIG. 7, in case that the emission signal generating circuit EC is configured to be divided at the neighboring scan circuit regions SA, the first circuit portion De1 and the second circuit portion De2 of the stage STGe may need to be connected to each other for a signal transmission therebetween, and to do this, the transmission line TL may be formed.

Further, according to a design and the like of the scan driving circuit 500, it may be required that the first or second logic voltage VGL or VGH is supplied to a circuit portion in the other scan circuit region SA different from the scan circuit region SA where the second voltage line PL2 transferring the first or second logic voltage VGL or VGH is located, or that the first or second emission clock signal ECLK or ECLKb is supplied to a circuit portion in the other scan circuit region SA different from the scan circuit region SA where the clock signal line CL transferring the first or second emission clock signal ECLK or ECLKb is located, and to do this, the transmission line TL may be employed.

The transmission line TL may extend in parallel with the gate line GL along the row extension direction.

As described above, in this embodiment, the voltage lines PL1 transferring the low potential driving voltages VSS may be formed in the plurality of scan circuit regions SA. Accordingly, because a transfer line of a wide width to transfer the low potential driving voltages VSS may not need to be formed at the non-display region NA located at both sides of the display region AA, a width of the non-display region NA can be reduced and a narrow bezel can be realized effectively.

Figure 8:
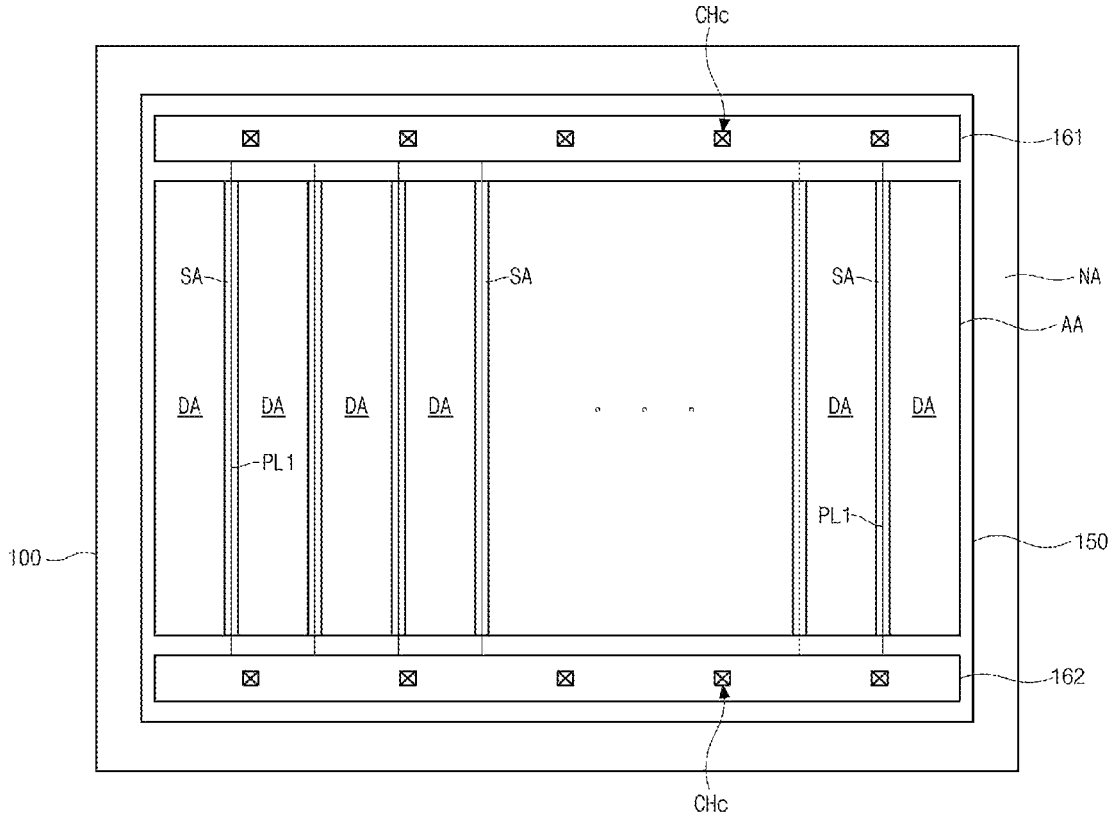
FIG. 8 is a view schematically illustrating an example of a cathode of a display panel and lines transferring low potential driving voltages according to an embodiment of the present disclosure.

FIG. 8 is a view schematically illustrating an example of a cathode of a display panel and lines transferring low potential driving voltages according to an embodiment of the present disclosure.

Referring to FIG. 8, in the display panel 100, the cathode 150 may be formed corresponding to the display region AA. The cathode 150 may be formed, for example, in a single body all over the display region AA, and may correspond to all of the sub-pixels SP arranged in the display region AA.

In the non-display region NA located at an upper side and a lower side of the display region AA, first and second power lines 161 and 162 which are lines having relatively wide widths may be formed. The first and second power lines 161 and 162 may be formed to extend along the row line direction as the horizontal direction.

The first power line 161 may be located at the upper-side non-display region NA of the display panel 100 which the low potential driving voltage VSS output from the power supply circuit 400 is input to, and may receive the low potential driving voltage VSS input to the display panel 100.

The second power line 162 may be located at the lower-side non-display region NA of the display panel 100 opposite to the first power line 161.

The plurality of first voltage lines PL1 formed in the plurality of scan circuit regions SA in the display region AA may be connected to the first power line 161 at one ends (or upper ends) of the first voltage lines PL1, and may be connected to the second power line 162 at the other ends (or lower ends) of the first voltage lines PL1.

The first and second power lines 161 and 162 may have relatively wide widths, each of which may be greater than a width of each first voltage line PL1.

The low potential driving voltage VSS applied to the first power line 161 may be transferred along a downward direction through the plurality of first voltage lines PL1 which are formed in the plurality of scan circuit regions SA in the display region AA, and then may supply to the second power line 162.

At least one contact hole CHc may be formed on the first power line 161. Similarly, at least one contact hole CHc may be formed on the second power line 162.

The cathode 150 may extend such that an upper edge portion (or a first edge portion) of the cathode 150 overlaps the first power line 161, and the upper edge portion may contact the first power line 161 therebelow through the contact hole CHc. Similarly, the cathode 150 may extend such that an lower edge portion (or a second edge portion) of the cathode 150 overlaps the second power line 162, and the lower edge portion may contact the second power line 162 therebelow through the contact hole CHc.

Accordingly, the cathode 150 may receive the low potential driving voltage VSS supplied to the first and second power lines 161 and 162. Because the cathode 150 receives the low potential driving voltage VSS from the upper edge portion and the lower edge portion, a deviation of the low potential driving voltage VSS (i.e., a deviation of rise of the low potential driving voltage VSS) by position in the display region AA can be prevented from happening. Thus, a reduction of a display quality caused by a deviation of the low potential driving voltage VS S can be prevented.

Further, in this embodiment, in order to transfer the low potential driving voltage VSS in a downward direction, the voltage line PL1 may be formed in the scan circuit region SA defined in the display region AA.

Accordingly, a transfer line of a wide width to transfer the low potential driving voltage VSS in a downward direction does not need to be formed at both-side portions of the non-display region NA. In other words, the voltage lines PL1 formed in the display region AA can substitute for the wide transfer line of the non-display region NA.

Thus, a width of the non-display region NA can be reduced, and a narrow bezel can be realized effectively.

Therefore, even though a display device is large-sized, the low potential driving voltage VSS can be uniform in the display region AA and a narrow bezel can be realized effectively.

An example of a structure of the pixel P and the common control circuit block C in the pixel block PB according to this embodiment of the present disclosure is explained below.

Figure 9:
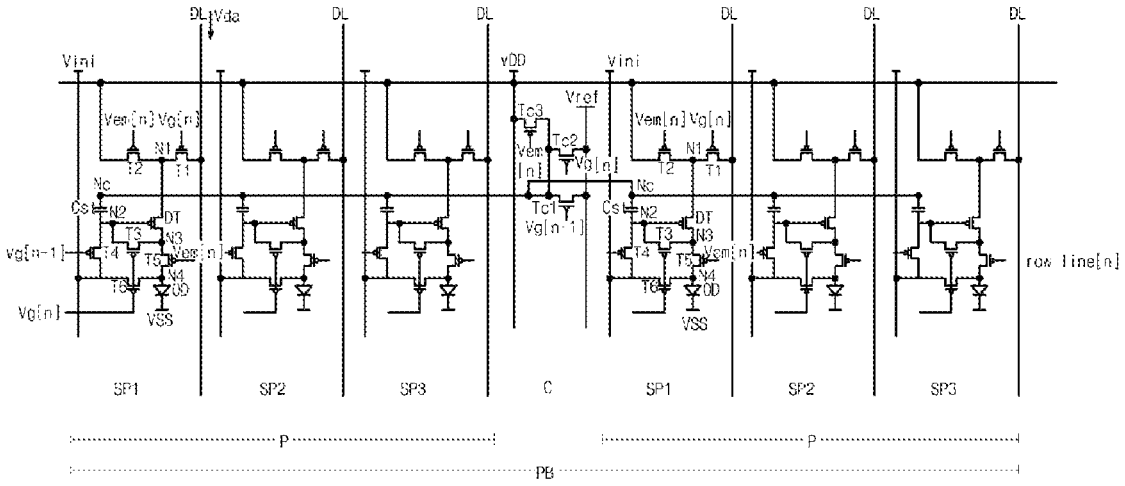
FIG. 9 is a view illustrating an example of a structure of a pixel and a common control circuit block in a pixel block according to an embodiment of the present disclosure.
Figure 10:
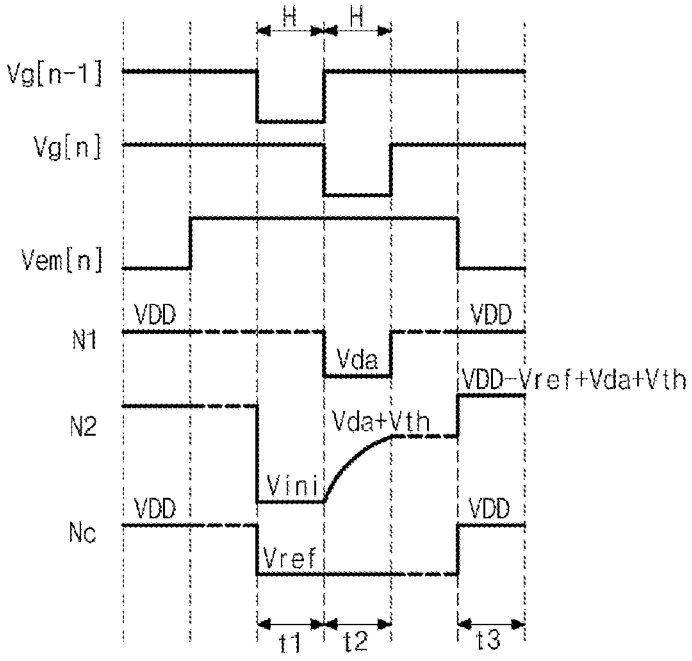
FIG. 10 is a waveform diagram of signals driving a pixel and a common control circuit block of FIG. 9 according to an embodiment of the present disclosure.

FIG. 9 is a view illustrating an example of a structure of a pixel and a common control circuit block in a pixel block according to an embodiment of the present disclosure. FIG. 10 is a waveform diagram of signals driving a pixel and a common control circuit block of FIG. 9.

Referring to FIG. 9, the pixel block PB of this embodiment may include the plurality of pixels P arranged along the row line direction, and the common control circuit block C located between the neighboring pixels P.

In this embodiment, for the purpose of explanations, the pixel block PB configured with two pixels P and one common control circuit block C between the two pixels P is shown by way of example, and a row line on which the pixel block PB is located is assumed as a $n^{th}$ row line.

Each pixel P may be configured with a plurality of sub-pixels SP which neighbor each other along the row line direction and have different colors. For example, the plurality of sub-pixels SP of the pixel P may include a first sub-pixel SP1 of a red, a second sub-pixel SP2 of a green, and a third sub-pixel SP3 of a blue.

The common control circuit block C may be connected in common to the first to third sub-pixels SP1 to SP3 of the pixels P adjacent to the common control circuit block C, and may control storage capacitors Cst of these sub-pixels SP1 to SP3 in common.

Regarding a structure of each sub-pixel SP, in this embodiment, an internal compensation structure to compensate for a threshold voltage of a driving transistor DT may be employed. In this regard, a 7T1C structure is described by way of example.

Each sub-pixel SP may include driving elements which are first to sixth transistors T1 to T6 as switching transistors, the driving transistor DT and a storage capacitor Cst. Each sub-pixel SP may include an emitting element, driven by the driving element, which is a light emitting diode OD.

For the purpose of explanations, the transistors T1 to T6 and DT formed of P type transistors are described by way of example. In another example, the transistors T1 to T6 and DT may be formed of N type transistors.

Regarding the first transistor T1, a gate electrode may be connected to a gate line of its corresponding row line which is the $n^{th}$ row line, and a source electrode may be connected to a data line DL, and a drain electrode may be connected to a first node N1 i.e., a drain electrode of the second transistor T2 and a source electrode of the driving transistor DT.

The first transistor T1 may be turned on in response to a gate signal Vg[n] of the $n^{th}$ row line, and thus a data signal Vda provided through the data line DL may be applied to the first node N1.

Regarding the second transistor T2, a gate electrode may be connected to an emission line of the $n^{th}$ row line, a source electrode may be applied with the high potential driving voltage VDD as a second power voltage, and a drain electrode may be connected to the first node N1.

The second transistor T2 may be turned on in response to an emission signal Vem[n] of the $n^{th}$ row line, and thus the high potential driving voltage VDD may be applied to the first node N1.

Regarding the third transistor T3, a gate electrode may be connected to the gate line of the $n^{th}$ row line, a source electrode may be connected to a drain electrode of the driving transistor DT and a source electrode of the fifth transistor T5 i.e., a third node N3, and a drain electrode may be connected to a gate electrode of the driving transistor DT and a first electrode of the storage capacitor Cst i.e., a second node N2.

The third transistor T3 may be turned on in response to the gate signal Vg[n] of the $n^{th}$ row line, and thus the driving transistor may be in a state of diode connection.

Regarding the fourth transistor T4, a gate electrode may be connected to a gate line of a previous row line which is a $(n-1)^{th}$ row line, a source electrode may be applied with an initialization voltage Vini, and a drain electrode may be connected to the second node N2.

The fourth transistor T4 may be turned on in response to a gate signal Vg[n−1] of the $(n-1)^{th}$ row line, and thus the second node N2 i.e., the gate electrode of the driving transistor may be initialized with the initialization voltage Vini.

Regarding the fifth transistor T5, a gate electrode may be connected to the emission line of the $n^{th}$ row line, a source electrode may be connected to the third node N3, and a drain electrode may be connected to the light emitting diode OD and a drain electrode of the sixth transistor T6 i.e., a fourth node N4.

The fifth transistor T5 may be turned on in response to the emission signal Vem[n] of the $n^{th}$ row line, and thus an emission driving current produced through the driving transistor DT may be applied to the light emitting diode OD to emit the light emitting diode OD.

Regarding the sixth transistor T6, a gate electrode may be connected to the gate line of the $n^{th}$ row line, a source electrode may be applied with the initialization voltage Vini, and the drain electrode may be connected to the fourth node N4.

The sixth transistor T6 may be turned on in response to the gate signal Vg[n] of the $n^{th}$ row line, and thus the fourth node N4 i.e., the light emitting diode OD may be initialized with the initialization voltage Vini.

Regarding the storage capacitor Cst, the first electrode may be connected to the second node N2, and a second electrode may be connected to a common control node Nc. The common control node Nc may be connected to a voltage output terminal of the common control circuit block C.

The common control circuit block C may be coupled in common to the common control nodes Nc of the sub-pixels SP of the pixel P which are connected to the common control circuit block C. Accordingly, the sub-pixels SP of the pixel P may be applied in common with an output voltage output from the output terminal of the common control circuit block C and be thus controlled.

In this regard, the common control circuit block C may include a plurality of switching transistors, for example, first to third common control transistors Tc1 to Tc3. In this embodiment, the first to third common control transistors Tc1 to Tc3 may be formed of P type transistors. Alternatively, the first to third common control transistors Tc1 to Tc3 may be formed of N type transistors.

The first and second common control transistors Tc1 and Tc2 may be connected in parallel to each other.

Regarding the first common control transistor Tc1, a gate electrode may be connected to the gate line of the $(n-1)^{th}$ row line, a source electrode may be applied with a reference voltage Vref, and a drain electrode may be connected to an output terminal of the common control circuit block C i.e., the common control node Nc of the sub-pixel SP.

Regarding the second common control transistor Tc2, a gate electrode may be connected to the gate line of the $n^{th}$ row line, a source electrode may be applied with the reference voltage Vref, and a drain electrode may be connected to the output terminal of the common control circuit block C i.e., the common control node Nc of the sub-pixel SP.

In this case, the first common control transistor Tc1 may be turned on in response to the gate signal Vg[n−1] of the $(n-1)^{th}$ row line and may thus output the reference voltage Vref.

The second common control transistor Tc2 may be turned on in response to the gate signal Vg[n] of the $n^{th}$ row line and may thus output the reference voltage Vref.

For a horizontal period of the previous row line and a horizontal period of the current row line, the common control circuit block C may be operated to output the reference voltage Vref.

Regarding the third common control transistor Tc3, a gate electrode may be connected to the emission line of the $n^{th}$ row line, a source electrode may be applied with the high potential driving voltage VDD, and a drain electrode may be connected to the output terminal of the common control circuit block C i.e., the common control node Nc of the sub-pixel SP.

In this case, the third common control transistor Tc3 may be turned on in response to the emission signal Vem[n] of the $n^{th}$ row line and may thus output the high potential driving voltage VDD.

Operations of the sub-pixels SP in the pixel P using the common control circuit block C are described.

The sub-pixel SP of this embodiment may, every frame, perform an initialization operation for an initialization time t1, perform a sampling operation of a threshold voltage of the driving transistor DT for a sampling time t2, and perform an emission operation for an emission time t3.

Regarding the initialization operation, for the sub-pixel SP on the $n^{th}$ row line, the initialization time t1 may set for the horizontal period H of the $(n-1)^{th}$ row line, and the initialization operation may be performed.

In the initialization time t1, the fourth transistor T4 of the sub-pixel SP may be turned on by the gate signal Vg[n−1] of the $(n-1)^{th}$ row line. Accordingly, the initialization voltage Vini may be applied to the second node N2, and the gate electrode of the driving transistor DT may be initialized.

In the initialization time t1, the first common control transistor Tc1 of the common control circuit block C may be turned on by the gate signal Vg[n−1] of the $(n-1)^{th}$ row line. Accordingly, the reference voltage Vref may be output from the common control circuit block C and be applied to the common control node Nc of the sub-pixel SP.

Regarding the sampling operation, for the sub-pixel SP on the $n^{th}$ row line, the sampling time t2 may set for the horizontal period H of the $n^{th}$ row line, and the sampling operation may be performed.

In the sampling time t2, the first, third and sixth transistors T1, T3 and T6 of the sub-pixel SP may be turned on by the gate signal Vg[n] of the $n^{th}$ row line. Accordingly, the gate electrode and the drain electrode of the driving transistor DT may be in a short-circuit state i.e., a connection state and the threshold voltage Vth of the driving transistor DT may be sampled, and thus the second node N2 i.e., the gate electrode of the driving transistor DT may be charged to a sum (Vda+Vth) of the data voltage Vda and the threshold voltage Vth. Further, by turning on the sixth transistor T6, the initialization voltage Vini may be applied to the fourth node N4, and thus the anode of the light emitting diode OD may be initialized.

In the sampling time t2, the second common control transistor Tc2 of the common control circuit block C may be turned on by the gate signal Vg[n] of the $n^{th}$ row line. Accordingly, the reference voltage Vref may be output and be applied to the common control node Nc of the sub-pixel SP.

Regarding the emission operation, after a predetermined time (e.g., a horizontal period of a $(n+1)^{th}$ row line) from an end of the sampling time t2, the emission time t3 may be set and the emission operation may be performed.

In the emission time t3, the second and fifth transistors T2 and T5 of the sub-pixel SP may be turned on by the emission signal Vem[n] of the $n^{th}$ row line. Accordingly, by turning on the second transistor T2, the high potential driving voltage VDD may be applied to the first node N1 i.e., the source electrode of the driving transistor DT. Further, by turning on the fifth transistor T5, the emission driving current produced through the driving transistor DT may be applied to the light emitting diode OD, and thus the light emitting diode OD may be emitted.

In the emission time t3, the third common control transistor Tc3 of the common control circuit block C may be turned on by the emission signal Vem[n] of the $n^{th}$ row line. Accordingly, the high potential driving voltage VDD may be output and be applied to the common control node Nc of the sub-pixel SP.

As the high potential driving voltage VDD may be applied to the common control node Nc in the emission time t3, the second node N2 connected to the first electrode of the storage capacitor Cst may have a voltage change by a voltage change amount (VDD−Vref) of the common control node Nc. In other words, the voltage of the second node N2 may become (VDD−Vref+Vda+Vth).

Based on this, the emission driving current may be produced according to the following formula.

$Iod=K*\{Vgs-Vth\}^2=K*\{((VDD-Vref+Vda+Vth)-VDD)-Vth\}^2=\{Vda-Vref\}^2$. Vgs is a voltage difference between the gate electrode and the source electrode of the driving transistor DT, and K is a constant.

As described above, according to this embodiment, a deviation of the threshold voltage Vth of the driving transistor DT can be compensated, and further, a deviation of the high potential driving voltage VDD can be compensated.

Regarding the compensation of the high potential driving voltage VDD, the high potential driving voltage VDD may drop along a line transferring it in the display panel 100, and a deviation of the high potential driving voltage VDD by position may happen.

In this embodiment, using the common control circuit block C, a charging voltage of the storage capacitor Cst may be controlled in common. Accordingly, a component of the high potential driving voltage VDD may be reduced in producing the emission driving current, and thus an emission deviation caused by a deviation of the high potential driving voltage VDD can be prevented and a display quality can be secured.

Further, the common control circuit block C may control the pixel P as a minimum unit in common. Accordingly, compared with configuring a voltage control circuit by a unit of a sub-pixel to compensate for a deviation of the high potential driving voltage VDD, a control circuit can be reduced greatly.

Further, in this embodiment, the threshold voltage Vth can be directly detected through the data voltage Vda, and in a driving process, an electric short-circuit between the high potential driving voltage VDD and the reference voltage Vref can be prevented. Thus, a detection performance of the threshold voltage Vth can be improved.

Further, referring to the driving timings of FIG. 10, it is seen that after the initialization time and the sampling time for two neighboring row lines (e.g., the $(n-1)^{th}$ row line and the $n^{th}$ row line) are finished, these two row lines are able to be applied to the same emission signal and to emit at the same time. Accordingly, the emission signal generating circuit may be configured by two row lines, and a size of the scan driving circuit 500 can be reduced.

As described above, according to the embodiment of the present disclosure, the GIP type scan driving circuit may be formed at the plurality of scan circuit regions in the display region. Accordingly, the scan driving circuit does not need to be formed in the non-display region, and thus a narrow bezel can be realized effectively.

Further, a line transferring the low potential driving voltage may be located in the scan circuit region. Accordingly, a wide line transferring the low potential driving voltage does not need to be formed in the non-display region, thus a width of the non-display region can be reduced, and thus a narrow bezel can be realized effectively.

Further, lines, which transfer DC-waveform voltages and are able to block an interference of the clock signal, may be located at both sides of the clock signal line formed in the scan circuit region. Accordingly, the interference of the clock signal with the pixel arrangement region adjacent to the scan circuit region can be prevented, and a display quality can be secured.

Further, the pixel block, in which the pixel and the common control circuit block are arranged alternately, may be located in the pixel arrangement region, and the scan circuit region may be placed in a region where the common control circuit block is able to be located in an order of arrangement. Accordingly, an extra region for the scan driving circuit does not need to be prepared additionally in the display region, and a regularity of the pixel and the driving circuit to drive the pixel, which is the common control circuit block and the scan driving circuit, being arranged alternately in the display region can be maintained substantially, and thus a display quality can be secured.

An arrangement of the scan driving circuit other than the arrangement of the scan driving circuit as an example of the above-described embodiment is explained below.

Figure 11:
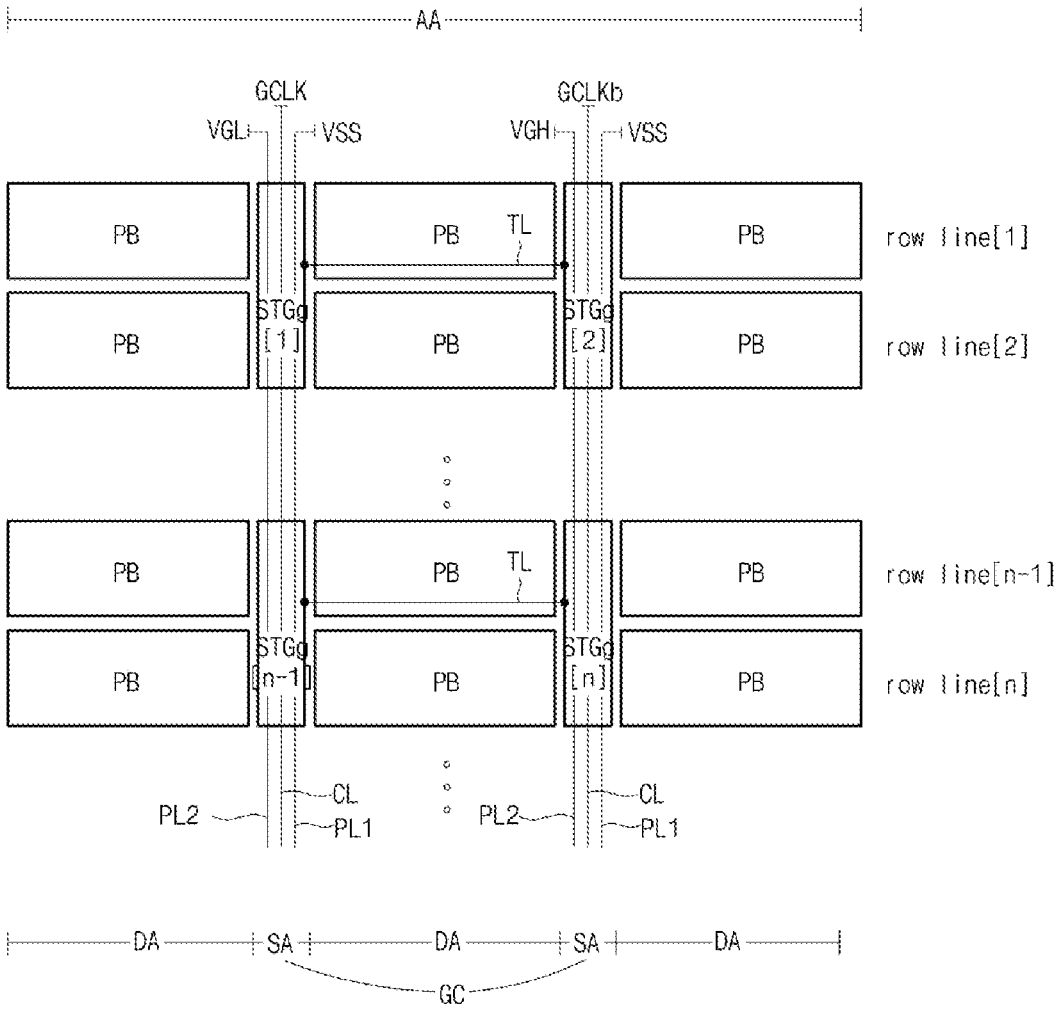
FIG. 11 is a view schematically illustrating an example of an arrangement of a gate signal generating circuit of a scan driving circuit according to another embodiment of the present disclosure.

FIG. 11 is a view schematically illustrating an example of an arrangement of a gate signal generating circuit of a scan driving circuit according to another embodiment of the present invention.

In FIG. 11, for the purpose of explanations, one gate signal generating circuit GC located in the display region AA is shown. Detailed explanations of parts identical to or similar to parts of the above embodiment may be omitted.

Referring to FIG. 11, each gate signal generating circuit GC may be formed at neighboring scan circuit regions SA, for example, may be formed to disperse at two neighboring scan circuit regions SA. In this regard, some stages STGg of the gate signal generating circuit GC may be formed at one of the two scan circuit regions SA, and the other stages STGg of the gate signal generating circuits may be formed at the other of the two scan circuit regions SA.

Regarding the stages STGg constituting the gate signal generating circuit GC, two stages STGg respectively corresponding to two neighboring row lines may be respectively formed at two scan circuit regions SA.

For example, the first stage STG[1] generating a gate signal to drive the first row line may be located at the left scan circuit region SA, and the second stage STG[2] generating a gate signal to drive the second row line may be located at the right scan circuit region SA. Similarly, the $(n-1)^{th}$ stage STG[n−1] generating a gate signal to drive the $(n-1)^{t}$ row line may be located at the left scan circuit region SA, and the $n^{th}$ stage STG[n] generating a gate signal to drive the $n^{th}$ row line may be located at the right scan circuit region SA.

In this embodiment, instead of each stage STGg being formed to be divided in the neighboring scan circuit regions SA, each stage STGg may be formed in a corresponding one scan circuit region SA.

In this case, for example, each stage STGg may be formed to correspond to about a region of two row lines.

In this embodiment, each stage STGg may be located in the corresponding one scan circuit region SA, a design of circuit can be simplified compared with the above embodiment.

Even in this embodiment, the transmission line TL transferring signals between the neighboring scan circuit regions SA may be formed.

For example, similarly to the above embodiment, it may be required that the first or second logic voltage VGL or VGH is supplied to a circuit (i.e., a stage) in the other scan circuit region SA different from the scan circuit region SA where the second voltage line PL2 transferring the first or second logic voltage VGL or VGH is located, or that the first or second gate clock signal GCLK or GCLKb is supplied to a circuit (i.e., a stage) in the other scan circuit region SA different from the scan circuit region SA where the clock signal line CL transferring the first or second gate clock signal GCLK or GCLKb is located, and to do this, the transmission line TL may be employed.

The arrangement of FIG. 11 may be applied to an arrangement of an emission signal generating circuit. In other words, regarding the emission signal generating circuit formed in the plurality of scan circuit regions, each stage of this emission signal generating circuit may be formed in a corresponding one scan circuit region.

Figure 12:
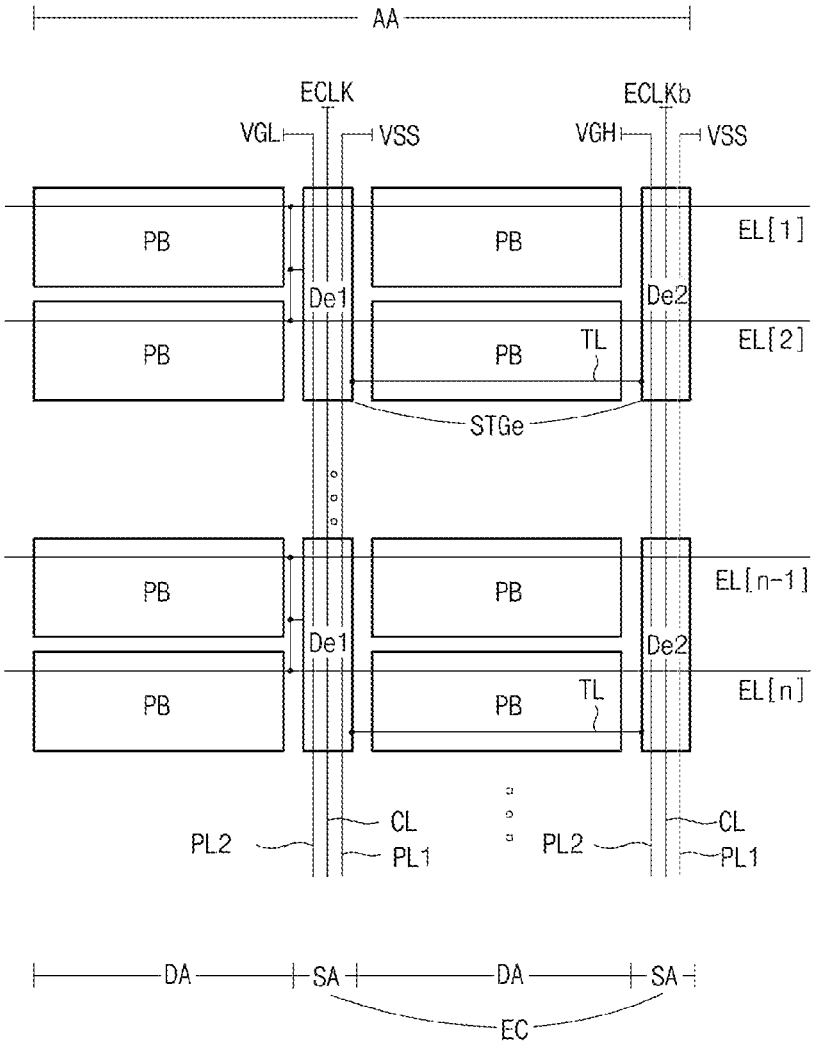
FIG. 12 is a view schematically illustrating an example of an arrangement of an emission signal generating circuit of a scan driving circuit according to another embodiment of the present disclosure.

FIG. 12 is a view schematically illustrating an example of an arrangement of an emission signal generating circuit of a scan driving circuit according to another embodiment of the present disclosure.

In FIG. 12, for the purpose of explanations, one emission signal generating circuit EC located in the display region AA is shown. Detailed explanations of parts identical to or similar to parts of the above embodiments may be omitted.

Referring to FIG. 12, each emission signal generating circuit EC may be formed at neighboring scan circuit regions SA, for example, may be formed to disperse at two neighboring scan circuit regions SA.

Regarding the stages STGe constituting the emission signal generating circuit EC, each stage STGe may be configured with first and second circuit portions De1 and De2 which are formed separately at the two scan circuit regions SA.

In this embodiment, an emission signal output from each stage STGe may be applied in common to two neighboring row lines. In other words, one emission signal by two row lines may be produced so that an output from each stage STGe may drive two row lines.

Regarding this structure, as the emission signal generating circuit EC of FIG. 12, the emission signal generating circuit EC, in which one stage STGe is formed corresponding to two row lines, may be used.

In this case, a number of circuits constituting the emission signal generating circuit EC may be reduced about by half.

Figure 13:
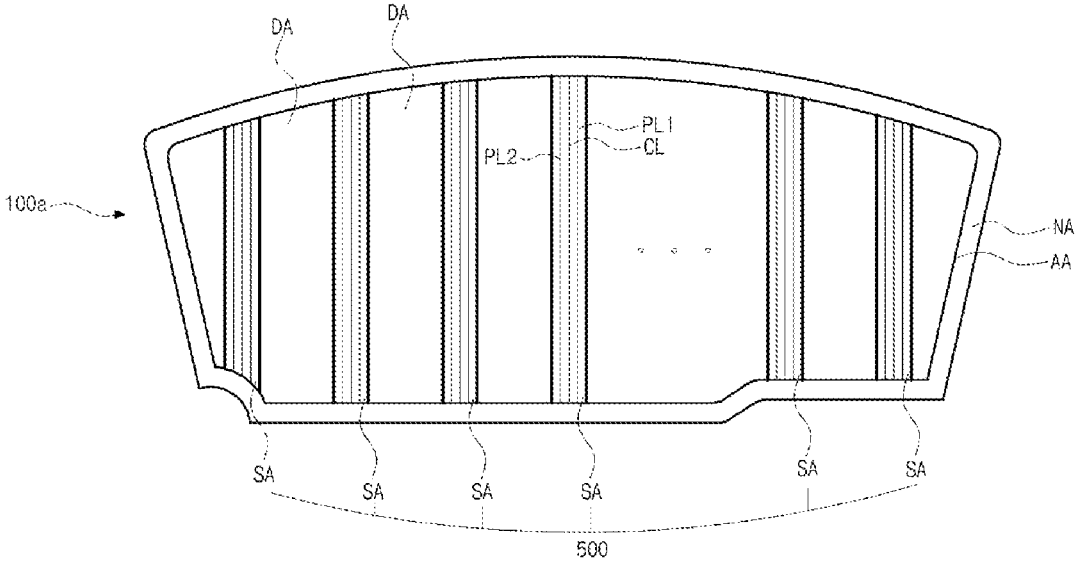
FIG. 13 is a view schematically illustrating a display panel of an electroluminescent display device according to another embodiment of the present disclosure.

FIG. 13 is a view schematically illustrating a display panel of an electroluminescent display device according to another embodiment of the present disclosure.

In this embodiment, detailed explanations of parts identical to or similar to parts of the above embodiments may be omitted.

Referring to FIG. 13, the display panel 100*a* of the electroluminescent display device of this embodiment may have a variant shape (or a freeform shape) different from a rectangular shape which is general (or conventional).

In this regard, the variant-shaped display panel 100*a* may, for example, have at least one side line, of an upper-side line, a lower-side line, a left-side line and a right-side line, which is not straight but has a curvature or is bent. In FIG. 13, all of the four side lines not being straight is shown by way of example.

In the variant-shaped display panel 100*a*, for the row line direction and/or the column line direction, a length by position may not be equal but may be different. In other words, a horizontal resolution and/or a vertical resolution by position may be different. For example, referring to FIG. 13, a length in the row line direction may not be equal on the whole but may be different, and also, a length in the column line direction may not be equal on the whole but may be different.

Even for the variant-shaped display panel 100*a*, the scan driving circuit 500 may be formed in a GIP type in the display region AA as in the above embodiments.

In this regard, the display region AA may include a plurality of pixel arrangement regions DA as regions in which pixels are arranged, and a plurality of scan circuit regions SA as regions which are located between the plurality of pixel arrangement regions DA and form the scan driving circuit 500.

A plurality of pixels arranged in a matrix form may be located in each pixel arrangement region DA, and the pixel arrangement region DA may substantially produce an image. The pixel arrangement regions DA may extend in parallel with each other along the column line direction, and may be separated from each other with the scan circuit regions SA therebetween along the row line direction.

Each scan circuit region SA may be located between the neighboring pixel arrangement regions DA, and a partial circuit constituting the scan driving circuit 500 may be formed at each scan circuit region SA. The scan circuit regions SA may extend in parallel with each other along the column line direction, and may be separated from each other with the pixel arrangement regions DA therebetween along the row line direction.

As described above, the display region AA may be configured such that the scan circuit regions SA are dispersed inside the display region AA and the pixel arrangement regions DA as actual image display regions are divided.

In this embodiment, the variant-shaped display panel 100*a* may be used, and the display region AA of the variant-shaped display panel 100*a* may also have the variant shape like the display panel 100*a*.

Accordingly, a number of the scan circuit regions SA along the row line direction may be different by position. In this regard, since the display region AA has the variant shape, all of the row lines may not be equal in length but may be different in length by position. For example, referring to FIG. 13, a number of the scan circuit regions SA located at a relatively upper row line may be greater than a number of the scan circuit regions SA located at a relatively lower row line.

Accordingly, a number of the gate signal generating circuits and a number of the emission signal generating circuits may be different by position of row line.

Like the above embodiments, the clock signal line CL transferring the clock signal may be located in the scan circuit region SA. Through the clock signal line CL, the gate signal generating circuit or the emission signal generating circuit located in the corresponding scan circuit region SA may be supplied with the corresponding clock signal.

Further, like the above embodiments, in the scan circuit region SA, the voltage line transferring the voltage of the DC waveform may be located. In this regard, the first voltage line PL1 transferring the low potential driving voltage and the second voltage line PL2 transferring the logic voltage may be located at both sides of the clock signal line CL.

As described above, the electroluminescent display device may include the variant-shaped display panel 100*a*, and the variant-shaped display panel 100*a* may be configured such that the GIP type scan driving circuit may be formed in the plurality of scan circuit regions in the display region.

Accordingly, a deviation of scan signal and a deviation of brightness by position caused in a variant-shaped display panel including a scan driving circuit formed in a non-display region of the display panel can be prevented. Further, a narrow bezel can be realized, and the display panel may be formed in any of various shapes as required without restriction.

Even though not described in detail, the same or like configurations of the electroluminescent display devices of the above embodiments may be applied to the electroluminescent display device of this embodiment.

According to the above-described embodiments of the present disclosure, that the GIP type scan driving circuit may be formed in the plurality of scan circuit regions in the display region. Accordingly, the scan driving circuit does not need to be formed in the non-display region, and thus a width of the non-display region can be reduced and a narrow bezel can be realized effectively.

Further, the line transferring the low potential driving voltage may be located in the scan circuit region. Accordingly, the line of a wide width transferring the low potential driving voltage does not need to be formed in the non-display region, and thus a width of the non-display region can be reduced and a narrow bezel can be realized effectively.

Further, the lines transferring the voltages of DC waveform to block an interference of the clock signal may be located at both sides of the clock signal lines formed in the scan circuit region. Accordingly, an interference of the clock signal with the pixel arrangement region adjacent to the scan circuit region can be prevented, and a display quality can be secured.

Further, the pixel block, in which the pixel and the common control circuit block are arranged alternately, may be located in the pixel arrangement region, and the scan circuit region may be placed in a region where the common control circuit block is able to be located in an order of arrangement. Accordingly, an extra region for the scan driving circuit does not need to be prepared additionally in the display region, and a regularity of the pixel and the driving circuit to drive the pixel, which is the common control circuit block and the scan driving circuit, being arranged alternately in the display region can be maintained substantially, and thus a display quality can be secured.

It will be apparent to those skilled in the art that various modifications and variation can be made in the present invention without departing from the spirit or scope of the disclosure. Thus, it is intended that the present disclosure cover the modifications and variations of this disclosure provided they come within the scope of the appended claims and their equivalents.

What is claimed is:

1. An electroluminescent display device, comprising:

a display panel including a display region, which includes a plurality of pixel arrangement regions and a plurality of scan circuit regions between the plurality of pixel arrangement regions, and a non-display region around the display region, wherein each scan circuit region is interposed between two neighboring pixel arrangement regions;

a scan driving circuit formed in the plurality of scan circuit regions; and a clock signal line transferring a clock signal, and a first voltage line and a second voltage line located at both sides of the clock signal line, the clock signal line and the first voltage line and the second voltage line being located in the scan circuit region, wherein the first voltage line transfers a low potential driving voltage which is supplied to a cathode corresponding to the display region.

2. The electroluminescent display device of claim 1, wherein the second voltage line transfers a low logic voltage or high logic voltage supplied to the scan driving circuit.

3. The electroluminescent display device of claim 1, further comprising a first power line and a second power line which are located at opposite sides with the display region therebetween and are respectively connected to both ends of the first voltage line, wherein the first power line and the second power line respectively overlap and contact a first edge portion and a second edge portion of the cathode.

4. The electroluminescent display device of claim 1, wherein the pixel arrangement region includes a pixel block located along each row line of the display panel, wherein the pixel block includes a plurality of pixels, and at least one common control circuit block located between the plurality of pixels, wherein the pixel includes a plurality of sub-pixels emitting different colors, and wherein the common control circuit block controls the plurality of sub-pixels of the pixel adjacent to the common control circuit block.

5. The electroluminescent display device of claim 4, wherein a width of the common control circuit block is equal to a width of the scan circuit region.

6. The electroluminescent display device of claim 4, wherein the sub-pixel includes a light emitting diode, a plurality of transistors including a driving transistor, and a storage capacitor which is connected between a gate electrode of the driving transistor and a common control node, and wherein the common control node is applied with a voltage output from an output terminal of the common control circuit block.

7. The electroluminescent display device of claim 6, wherein the plurality of transistors of the sub-pixel on a $n^{th}$ row line includes:

the driving transistor connected to the storage capacitor at a second node therebetween;

a first transistor connected to a gate line of the $n^{th}$ row line and a data line;

a second transistor connected to an emission line of the $n^{th}$ row line, applied with a high potential driving voltage, and connected to the first transistor at a first node;

a third transistor connected between a drain electrode and the gate electrode of the driving transistor;

a fourth transistor connected to a gate line of a $(n-1)^{th}$ row line, applied with an initialization voltage, and connected to the second node;

a fifth transistor connected to the emission line of the $n^{th}$ row line, connected to the drain electrode of the driving transistor at a third node, and connected to the light emitting diode at a fourth node; and a sixth transistor connected to the gate line of the $n^{th}$ row line, applied with the initialization voltage, and connected to the fourth node.

8. The electroluminescent display device of claim 6, wherein the common control circuit block located on a $n^{th}$ row line includes:

a first common control transistor connected to a gate line of a $(n-1)^{th}$ row line, applied with a reference voltage, and connected to the output terminal of the common control circuit block;

a second common control transistor connected to a gate line of the $n^{th}$ row line, applied with the reference voltage, and connected to the output terminal of the common control circuit block; and a third common control transistor connected to an emission line of the $n^{th}$ row line, applied with a high potential driving voltage, and connected to the output terminal of the common control circuit block.

9. The electroluminescent display device of claim 1, wherein the scan driving circuit includes a scan signal generating circuit generating a scan signal which is a gate signal or an emission signal, and wherein the scan signal generating circuit includes a plurality of stages sequentially outputting the scan signal.

10. The electroluminescent display device of claim 9, wherein each of the plurality of stages are formed separately in two neighboring scan circuit regions.

11. The electroluminescent display device of claim 9, wherein at least one stage of the plurality of stages are formed in one of the two neighboring scan circuit regions, and other stages of the plurality of stages are formed in the other of the two neighboring scan circuit regions.

12. The electroluminescent display device of claim 9, wherein each of the plurality of stages of the scan signal generating circuit generating the emission signal outputs the emission signal applied in common to two neighboring row lines of the display panel.

13. The electroluminescent display device of claim 1, further comprising a transmission line transmitting a signal between neighboring scan circuit regions.

14. An electroluminescent display device, comprising:

a display panel including a display region, which includes a plurality of pixel arrangement regions and a plurality of scan circuit regions between the plurality of pixel arrangement regions, and a non-display region around the display region, wherein each scan circuit region is interposed between two neighboring pixel arrangement regions;

a scan driving circuit formed in the plurality of scan circuit regions; and a clock signal line transferring a clock signal, and a first voltage line and a second voltage line located at both sides of the clock signal line, the clock signal line and the first voltage line and the second voltage line being located in the scan circuit region, wherein the first voltage line and the second voltage line transfer voltages of different DC waveforms.

15. The electroluminescent display device of claim 14, wherein the first voltage line transfers a low potential driving voltage which is supplied to a cathode corresponding to the display region.

16. The electroluminescent display device of claim 14, wherein the second voltage line transfers a low logic voltage or high logic voltage supplied to the scan driving circuit.

17. The electroluminescent display device of claim 15, further comprising a first power line and a second power line which are located at opposite sides with the display region therebetween and are respectively connected to both ends of the first voltage line, wherein the first power line and the second power line respectively overlap and contacts a first edge portion and a second edge portion of the cathode.

18. The electroluminescent display device of claim 14, wherein the pixel arrangement region includes a pixel block located along each row line of the display panel, wherein the pixel block includes a plurality of pixels, and at least one common control circuit block located between the plurality of pixels, wherein the pixel includes a plurality of sub-pixels emitting different colors, and wherein the common control circuit block controls the plurality of sub-pixels of the pixel adjacent to the common control circuit block.

19. The electroluminescent display device of claim 18, wherein a width of the common control circuit block is equal to a width of the scan circuit region.

20. The electroluminescent display device of claim 18, wherein the sub-pixel includes a light emitting diode, a plurality of transistors including a driving transistor, and a storage capacitor which is connected between a gate electrode of the driving transistor and a common control node, and wherein the common control node is applied with a voltage output from an output terminal of the common control circuit block.

21. An electroluminescent display device, comprising:

a display panel including a display region, which includes a plurality of pixel arrangement regions and a plurality of scan circuit regions between the plurality of pixel arrangement regions, and a non-display region around the display region;

a scan driving circuit formed in the plurality of scan circuit regions; and a clock signal line transferring a clock signal, and a first voltage line and a second voltage line located at both sides of the clock signal line, the clock signal line and the first voltage line and the second voltage line being located in the scan circuit region, wherein the first voltage line transfers a low potential driving voltage which is supplied to a cathode corresponding to the display region, wherein the clock signal line is interposed between the first voltage line and the second voltage line.

22. An electroluminescent display device, comprising:

a display panel including a display region, which includes a plurality of pixel arrangement regions and a plurality of scan circuit regions between the plurality of pixel arrangement regions, and a non-display region around the display region;

a scan driving circuit formed in the plurality of scan circuit regions; and a clock signal line transferring a clock signal, and a first voltage line and a second voltage line located at both sides of the clock signal line, the clock signal line and the first voltage line and the second voltage line being located in the scan circuit region, wherein the first voltage line and the second voltage line transfer voltages of different DC waveforms, wherein the clock signal line is interposed between the first voltage line and the second voltage line.

* * * * *